United States Patent [19]

Denbigh et al.

[11] Patent Number: 4,539,511

[45] Date of Patent: Sep. 3, 1985

[54] HIGH PRESSURE DISCHARGE LAMPS WITH MEANS FOR REDUCING RECTIFICATION

[75] Inventors: Paul L. Denbigh, Cossington; Richard J. Seddon, Rushey Mead; Bryan F. Jones, Leicester, all of England

[73] Assignee: THORN EMI plc, London, England

[21] Appl. No.: 414,925

[22] Filed: Sep. 3, 1982

[30] Foreign Application Priority Data

Sep. 4, 1981 [GB] United Kingdom ..... 8126865
Sep. 18, 1981 [GB] United Kingdom ..... 8128262
Jun. 7, 1982 [GB] United Kingdom ..... 8216518

[51] Int. Cl.[3] ..... H01J 61/073; H01J 61/20; H01J 61/22; H01J 61/36

[52] U.S. Cl. ..... 313/624; 313/625; 313/626; 313/634

[58] Field of Search ..... 313/634, 17, 623, 624, 313/625, 626, 25

[56] References Cited

U.S. PATENT DOCUMENTS 3,609,437 9/1971 Tol et al. ..... 313/634
4,160,930 7/1979 Driessen et al. ..... 313/601 X

FOREIGN PATENT DOCUMENTS 0028128 6/1981 European Pat. Off. .
2405335 8/1974 Fed. Rep. of Germany ..... 313/634
2713611 10/1978 Fed. Rep. of Germany ..... 313/634
468643 7/1937 United Kingdom .
523923 7/1940 United Kingdom .
951859 3/1964 United Kingdom .
1011525 12/1965 United Kingdom .
1240253 7/1971 United Kingdom .
1414442 11/1975 United Kingdom .
1465212 2/1977 United Kingdom ..... 313/634
1545385 5/1979 United Kingdom .
1587987 4/1981 United Kingdom .

OTHER PUBLICATIONS

"Extending the Life of Low-Power High-Pressure Sodium Lamps", P. L. Denbigh, BSc. MInstP, vol. 15, No. 4, 1983, pp. 171-178.

*Primary Examiner*—David K. Moore
*Assistant Examiner*—K. Wieder
*Attorney, Agent, or Firm*—Fleit, Jacobson, Cohn & Price

[57] ABSTRACT

In a high pressure sodium discharge lamp it has been found that rectification can be prevented by ensuring the amalgam does not make electrical contact with the electrode. To achieve this according to the invention a small shoulder member is provided on the inside face of the end wall. Although the small height effectively reduces the temperature differential between the bottom of the shoulder and the top the necessary differential to prevent the amalgam condensing out the top of the shoulder member is maintained by ensuring the width of the shoulder member is a predetermined minimum thickness.

11 Claims, 6 Drawing Figures

Figure 3:
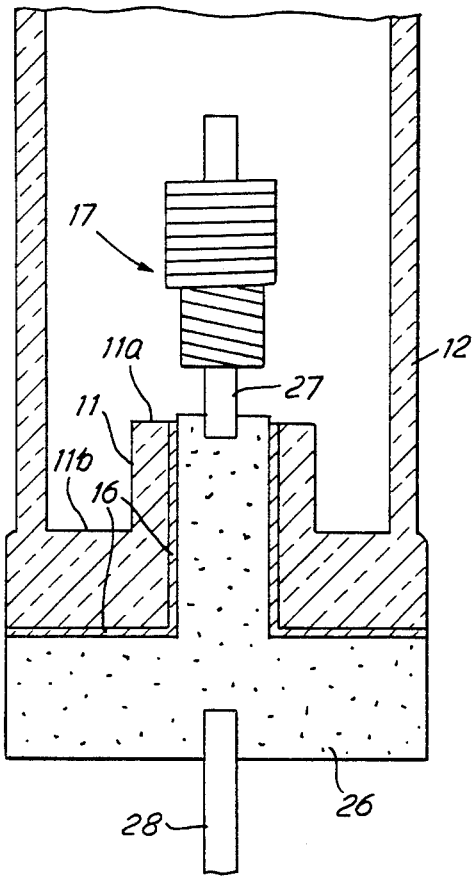

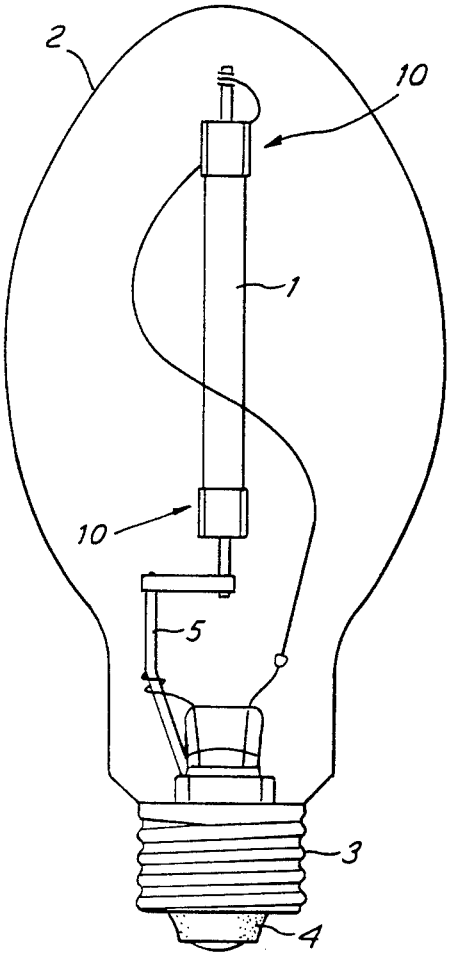
FIG. 1
FIG. 2
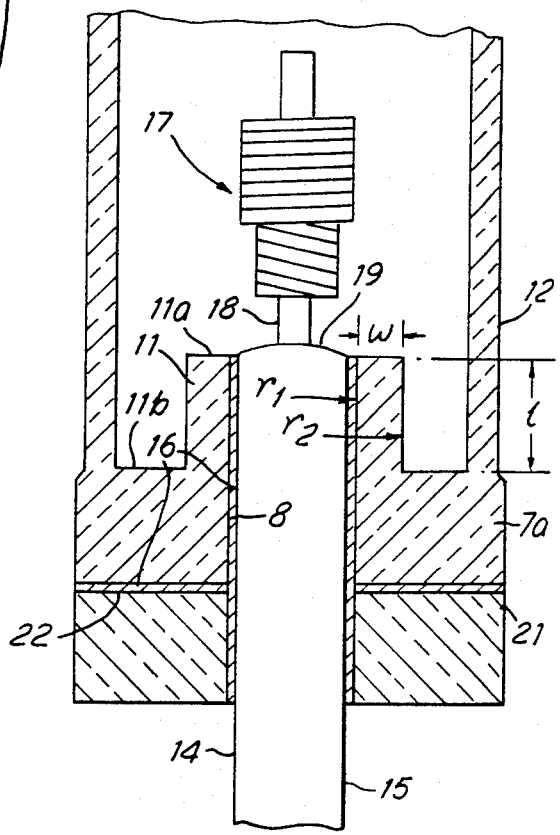

HIGH PRESSURE DISCHARGE LAMPS WITH MEANS FOR REDUCING RECTIFICATION

This invention relates to a high pressure discharge lamp comprising a discharge tube of a ceramic material having a fill which includes a vapour producing alkali metal. More particularly the invention relates to a high pressure sodium discharge lamp containing an amalgam of sodium and mercury having pressures of 30 to 1,000 torr of sodium and 0.1 to 5 atmospheres of mercury and in which Xenon can be included between 5–1000 torr, cold fill pressure.

Other lamps in which the invention could be used include lamps having a gas fill of Xenon or a gas fill comprising a mixture of Xenon with a smaller quantity, preferably 2 to 10% of the total, of a gas selected from argon, neon or a combination of both and filled to a total pressure of between 5 to 1,000 torr at 300K.

An object of this invention is to provide an improved construction of the end closure and electrode assembly of a high pressure discharge lamp.

According to the present invention there is provided a high pressure discharge lamp, said lamp including an arc tube of ceramic material, the arc tube including an end wall extending radially inwardly from the arc tube wall to define a central aperture, an electrical lead-in member sealed within the aperture along the length of said aperture, said lead-in member joined to an electrode shank member carrying an electrode element, said end wall including an inner surface exposed to radiation from the electrode element when the lamp is running, said inner surface including a shoulder member adjacent the central aperture, the height of the shoulder member above the inner surface not being sufficient to sustantially shield the inner surface from the electrode element and the width of the shoulder member being designed such that the temperature differential between the top surface of the shoulder and the inner surface is sufficient to prevent amalgam contacting the electrical lead in member.

In high pressure discharge lamps problems can be experienced with end blackening caused by material being sputtered from the electrodes and adhering to the discharge tube walls which affects the life of the lamp.

We have found with high pressure sodium lamps of 250 watts, 150 watts, 70 watts and 50 watts (although it is by no means expected that the problem is limited to these wattages), that the problem of end blackening caused by sputtering of material to the discharge walls is compounded by the problem of rectification which further reduces the life that can be attained. Rectification can occur during the starting period of a high-pressure sodium lamp if there are differences in the time that it takes to establish thermionic emission on the ends of the electrodes (that is to establish the normal operating conditions for the electrodes). Rectification manifests itself as a higher lamp voltage on one half cycle or portion of a half cycle, than on the succeeding half cycle. On a choke operated lamp circuit, the d.c. component of the current which flows as a result tends to saturate the magnetic core of the inductance and reduce its impedance, causing even larger currents to flow. In bad cases the peak d.c component can be over ten times the normal a.c. peak lamp current. During the starting period there is a tendency for the arc to terminate on the amalgam fill which is found only at one end of the lamp, rather than on the electrode. This occurs because the electrode is in contact with the amalgam. Particularly severe rectification occurs at this time. The large d.c. current components that result, cause excessive sputtering or evaporation of the emissive material which then accumulates on the arc tube wall, causing blackening. Consequently there is an increase in the temperature of the metal amalgam at the end of the arc tube which causes an increase in the vapour pressure of sodium and mercury which in turn causes the voltage across the lamp to rise. The voltage rises until the voltage across the AC mains supply cannot any longer sustain the lamp discharge and the lamp goes out. The blackening of the ends of the arc tube also causes a reduction in the light output thus affecting the efficacy of the lamp. At the same time, the arc terminating on the amalgam can cause severe damage to the alumina tube.

Various proposals have been made in the prior art involving some form of shielding, however, we have found unexpectedly that it is not necessary actually to screen the electrode element and a simple small shoulder member forming a barrier to the metal amalgam making electrical contact with the electrode support suffices.

In British Pat. No. 523,923, for example, there is disclosed a main electrode surrounded along its entire length by a quartz sleeve. In British Pat. No. 1,414,442 a high pressure discharge lamp is disclosed in which a reservoir is provided for the mercury or the amalgam which is said to prevent an irregular glowing of the arc near the electrode. The structure of some of the embodiments of this patent are designed in such a manner as to form a screen for the reservoir from the discharge space and, incidentally forms also a screen covering at least a part of the electrode element. As stated previously we have now found that it is not necessary actually to screen the electrode element to prevent rectification. In other embodiments of this patent the reservoir is formed within a ceramic plug sealed to the wall of the discharge space and the path into the reservoir for the amalgam is through an unsealed space between the current lead in member and part of the plug. This, of course, would not prevent the amalgam making contact with the electrode assembly should the amalgam proceed through the space to the reservoir.

In British Pat. No. 1,465,212 a high pressure sodium discharge lamp is disclosed wherein a closure member comprising a relatively long piece of polycrystalline alumina is sealed to the ends of the polycrystalline discharge tube. A tubular current lead-in member is joined to an electrode supporting shank member or rod and the tubular lead-in member is sealed within a bore formed in the alumina end closure member. The problem according to this patent is that the hot sodium vapour tends to react with the material of the seal and to protect the sealing material and prevent this, the joint between the current lead in member and the shank is effected within the bore of the end closure member so that the junction point is protected by an annular shield of polycrystalline alumina. A problem with this, however, is that since the junction point is below the surface of the annular shield a pocket is formed in which condensation could collect. In contrast to this the present invention is concerned with curing rectification, not with protecting sealing material, and to avoid forming such a pocket, it is preferred that the junction point between the current lead in member and the shank member should be outside the bore in which the current lead-in member is sealed.

As stated above we have found that it is not necessary actually to screen the electrode and, in fact, a simple small shoulder member suffices. This is advantageous in that it is easier to make than those prior art lamps involving a shield partly screening or wholly screening the electrode element. The tendency, however, with such a small shoulder member is to reduce the temperature differential between the top and the bottom of the shoulder member. Hence there is a risk that the amalgam could condense out onto the top surface of the shoulder member rather than at the bottom. We have found, however, that it is possible to compensate for this by suitably arranging the width of the shoulder member. If it is assumed that the heat radiated by the shoulder member is in accordance with the Stefan Boltzmann equation for radiation from a hot body and that heat is conducted in accordance with Fourier's law, then the temperature differential between the top and bottom surfaces can be maximised by arranging that the width of the shoulder is as thin as possible within practical manufacturing constraints.

The temperature at the top surface of the shoulder member and the temperature at the lower surface of the shoulder member are related by an appropriate formula, use of which gives:

The following table showing the temperature differential for a shoulder width of 0.2 and 0.5 mm for shoulder lengths of 1.5, 2, 3 and 4 mm.

For a low power lamp (250 watts or less) using a shoulder member with an inner radius of 0.92 mm; and a cool spot temperature of 973° K. the following table was produced.

| | Thickness w (mm) | |
|---|---|---|
| Length l (mm) | 0.2 | 0.5 |
| 1.5 | 53 | 18 |
| 2 | 73 | 24 |
| 3 | 116 | 36 |
| 4 | 165 | 49 |

From the table it is clear that for any given height of shoulder member '1' the temperature differential will be greater for a thinner section, that is, a smaller width 'w'. It is considered that a minimum temperature differential of about 10° C. will be sufficient to ensure that the amalgam will not make electrical contact with the electrode assembly. Of course differentials greater than this can be used.

Of course from a theoretical point of view there is no limit to the minimum width that would have this effect. However from practical manufacturing considerations it is believed 0.2 mm or just under and 0.5 mm are about the minimum widths that could be made under the present manufacturing techniques and knowledge in the art. 0.2 mm is about the limit based on a machining technique whereas 0.5 mm is about the limit using a pressing process. Moreover it should be appreciated that in order to maintain the temperature of the amalgam between 700° C. and 750° C. the electrode assembly will be positioned approximately 5 mm from the end of the arc tube. Given this constraint it is desirable to have a 1 mm clearance between the electrode element and the top of the shoulder member so that the discharge area will not be screened to any great extent by the shoulder member.

Preferably the shoulder member is formed as an integral part of the end wall construction of a monolithic arc tube. One method of doing this is to take a suitably shaped plug of ceramic material in the green state, insert this within a preformed arc tube of ceramic material also in the green state and sinter these components together to form a monolithic structure. Other ways of producing a monolithic arc tube can be used. An advantage of the monolithic structure is the absence of any sealing problems other than those concerned with the electrical lead in member in the arc tube.

An alternative to the monolithic structure is the use of a "top-hat" shaped member which is made as a separate preform and machined. An advantage of this is that it can be used in conjunction with a current lead in member of wire or rod rather than a tubular lead in member more common in the art.

Figure 4:
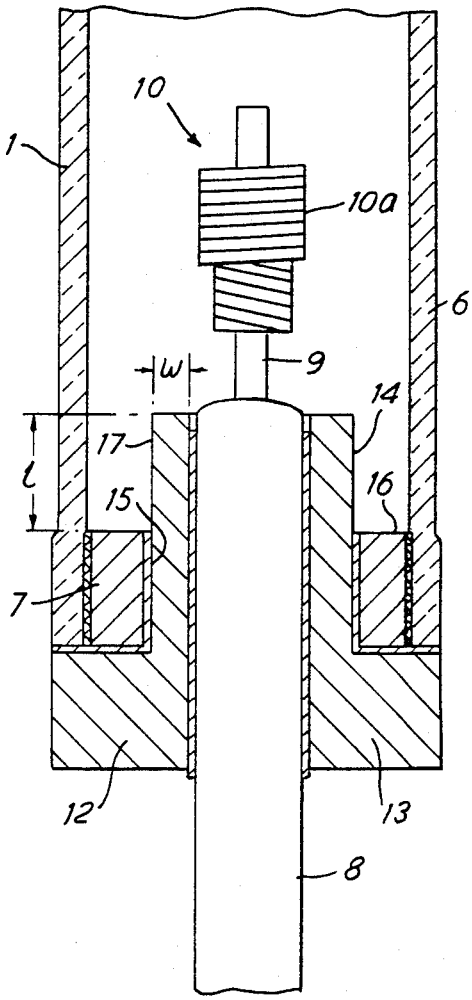
Figure 5:
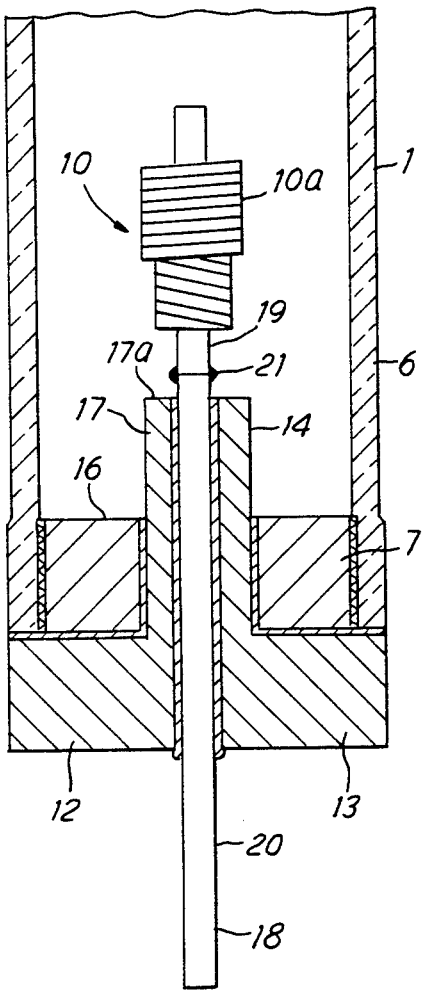
Figure 6:
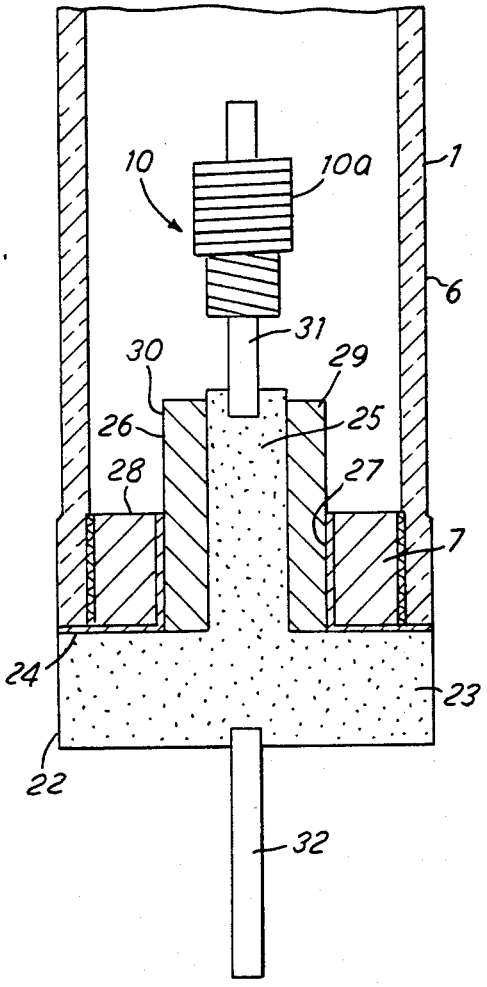

The invention will now be described by way of example only and with reference to the accompanying drawings wherein:

FIG. 1 is an elevation of a discharge lamp of the type according to the invention, FIG. 2 is a sectional elevation of one end of a discharge lamp arc tube having a shoulder member formed as an integral part of the arc tube end wall, FIG. 3 is a sectional elevation of an arc tube in accordance with another aspect of the invention where a shoulder member is formed as an integral part of an arc tube end wall, FIG. 4 is a sectional elevation of one end of a discharge lamp arc tube where a shoulder member is formed by means of a "top-hat" shaped member, FIG. 5 shows a sectional elevation of a discharge lamp arc tube in accordance with another aspect of the invention where the shoulder member is formed by means of a "top-hat" shaped member used in a lamp arc tube having a wire lead in member, and FIG. 6 is an arc tube in accordance with yet another aspect of the invention where the shoulder member is formed by means of a "top-hat" shaped member used in a lamp arc tube having a conducting cermet as a lead in member.

FIG. 1 shows a high pressure sodium vapour discharge lamp of 70 watts to which the invention is applicable. The lamp has a discharge tube 1, an outer envelope 2 of glass and a lamp base 3 with a terminal 4. The discharge tube 1 containing a sodium amalgam is supported within the envelope 2 by a metallic framework 5 in a well known manner. An electrode assembly 10 is situated at each end of the discharge tube 1. The operating conditions are arranged such that the sodium amalgam temperature at the coolest point of the tube will be in the range 650°-800° C.

FIG. 2 shows the use of the monolithic tube 12 with integral shoulder 11 for one end of an arc tube for a lamp 10. A current lead in member 14 which in this case is a niobium tube 15 is sealed by suitable sealing glass 16 within the bore 8 of the end wall 7*a* of the arc tube 12. An electrode element 17 which can be of the usual overwound coil form and which carries electron emissive material in a well known manner to sustain the discharge is carried by a supporting shank member 18. The shank member 18 in turn is held within the crimped over walls 19 of the niobium tube and this connection is completed by a charge of titanium braze metal (not shown) deposited in the inside of the niobium tube.

By arranging the tube 15 to be at least flush or even to emerge past the shoulder 11 thus protruding into the electrode discharge space no pockets are formed within the bore 8 in which condensation could collect. From FIG. 2 it will be apparent that the lead in member 14 is sealed along the length of the bore 8 in the end wall 7*a* including the portion of shoulder member 11 formed part of the bore 8. A cap member 21 optionally can be added as an additional sealing member being sealed to the outer face 22 by sealing glass 16.

In accordance with the invention by arranging the width "w" to be minimised the temperature differential over the length "l", that is between the top surface 11*a* of the shoulder member 11 and the bottom surface 11*b* will be sufficient to prevent amalgam contacting the electrical lead-in member. It is considered that a minimum temperature differential of about 10° C. will achieve this. It will be clear from FIG. 2 that the width 'w' will be a function of the inner and outer radii $r_1$ and $r_2$ and will depend on the size of the niobium tube or other lead-in member used. In order to keep the operating temperature of this lamp to be in the range 700° to 750° C. it is desirable to have the electrode height around 5 mm. Thus by arranging the maximum shoulder height "l" to be 4 mm a 1 mm clearance is obtained between the bottom of the electrode element 17 and the top surface of the shoulder 11*a*. Thus the bottom surface 11*b* forming the inner surface of end wall 7*a* is not substantially shielded from the radiation from the electrode element. In this way control of the cool spot temperature can be obtained. The above theoretical considerations apply equally in the other embodiments.

The construction shown in FIG. 3 is similar to that shown in FIG. 2 insofar as it comprises a monolithic tube 12 with integral shoulder 11. The current lead in member in this case comprises an electrically conducting cermet 26 in which the shank 27 of electrode 17 is embedded. Electrical connecting member 28 is also embedded in the cermet member which is sealed to the monolithic tube 12 by sealing glass 16. The use of our electrically conducting cermet is especially useful because it avoids having a separate seal for a current lead-in member.

In FIG. 4 there is shown in greater detail an electrode assembly 10 in accordance with another aspect of the invention. The assembly 10 is shown at one end of the discharge tube 1 but a similar assembly will generally be used at the other end.

The discharge tube 1 comprises an envelope wall 6 of translucent polycrystalline alumina. An annulus 7, also of translucent polycrystalline alumina, forming a sealing element is located within the ends of the envelope wall.

This assembly is formed initially by taking a discharge tube of polycrystalline alumina in the green state and an annulus of similar material, also in the green state and with the sealing element located within the envelope wall the assembly is sintered until it becomes a densely sintered monolithic seal. That is a monolithic structure forming a gas tight joint is formed along the length of the sealing element by sintering. The gas tight seal is represented by the cross hatched lines shown in the FIG. 4 the thickness of which is exaggerated for the sake of clarity. Of course it will be understood that since the sintered assembly forms a monolithic structure no such joint in practice will be apparent. The construction of the arc tube, therefore, will be substantially the same as is shown in FIG. 2, the difference being that the arc tube shown in FIG. 2 includes the integral shoulder member 11 whereas the arc tube shown in FIG. 4 does not. The electrode assembly 10 includes an electrical lead-in element 8 in the form of a niobium tube. The niobium tube is crimped around a shank member 9 and secured by titanium braze (not shown). The shank in turn supports an electrode element 10*a* which can be of the usual overwound coiled form and carries electron emissive material in a well known manner to sustain the discharge. The closure assembly includes a further member 12 which has a cover part 13 extending radually outwardly to cover the sealing element 7 and the end of the arc tube wall as shown in FIG. 4. The further member 12 also includes a barrel portion 14 which extends longitudinally through the interior 15 of the sealing element 7. The barrel portion 14 extends beyond the inner face 16 of the sealing element 7 and forms a shoulder member 17. It will be appreciated that the inner face 16 of the sealing element 7 is the equivalent of the inner surface of the end wall 11*b* described in the previous embodiments.

FIG. 5 shows a further example of the invention, as for FIG. 4 the discharge tube 1 comprises an envelope wall 6 of translucent polycrystalline alumina together with a polycrystalline alumina annular sealing element 7 and with the two being sintered together to form a monolithic structure as previously described with regard to FIG. 4. This example also includes a further member 12 having a cover part 13 and a barrel portion 14 sealed within the interior of the sealing element 7. As before the barrel portion 14 protrudes beyond the inner face 16 to form a shoulder 17, again all as previously described. In this example, however, the electrode assembly 10 including the electrode element 10*a* is supported by a wire current lead-in member 18 which includes a tungsten shank portion 19 and a niobium lead-in portion 20 sealed within the bore of the barrel. The portion 19 can be joined to the portion 18 at 21, for example, by welding. This design is advantageous in that the dissimilar metals can be chosen for their respective advantageous properties. For example niobium has expansion characteristics better matched to the alumina member 12 whereas tungsten is much tougher to withstand the higher temperature occurring near the electrode element 10*a*. To avoid problems of the alumina member cracking due to the differential expansion of the dissimilar metals it is preferable to form the joint 21 outside the barrel portion 14 in the discharge space as shown in FIG. 5. This further member 12 can again be made as a polycrystalline alumina "pre-form" by pressing in preference to machining and it is the assembly of the barrel portion 14 to within the interior of the annulus of the sealing element 7 which forms the shoulder 17 to act as a barrier to the metal amalgam making contact with the support shank 19. As before the assembly is sealed with suitable sealing glass as represented by the single hatched area shown in the drawing exaggerated in size for clarity. In this example the use of the wire lead-in member results in a smaller annular area of sealing material being exposed to the corrosive atmosphere inside the discharge tube during lamp operation. FIG. 6 illustrates another example of the invention. This example includes the polycrystalline alumina wall 6 with polycrystalline alumina sealing element in the form of an annulus 7 sintered to the envelope wall in a monolithic structure all as previously described with regards to FIGS. 4 and 5. In this case, however, the further member comprises an integrated conducting cermet and non-conducting material which may be either alumina or cermet as disclosed in our British Pat. No. 1,571,084. Briefly this comprises a member 22 similar in shape to the member 12 of FIGS. 4 and 5 including a cover portion 23 and barrel portion 26. The cover portion 23 extends radially to cover the sealing element 7 and the end face 24 of the envelope wall while the barrel portion extends longitudinally within the interior of the annulus of the sealing element 7. As taught in our aforementioned British Pat. No. 1,571,084 the barrel portion 26 includes an outer ring portion 29 of non-conducting material joined to a core 25 of conducting cermet material. This join is usually made by sintering the ring 29 around the core 25. The assembled integrated cermet 22 is then inserted within the interior of the annulus whereupon the extension of the barrel portion 26 beyond the inner face 28 of the sealing element 7 forms the shoulder 30. The electrode assembly 10 includes the electrode element 10*a* and from the drawing it is clear that the shoulder does not extend to cover the electrode element 10*a*. A support shank 31 for the electrode element 10*a* is attached to the conducting core 25 as is a conducting lead-in member 32.

In all of the embodiments described discharge tubes are used having bores ranging between 3 to 12 mm and a minimum width 'w', shown in FIG. 2, would be of around 0.2 mm. As previously stated the shoulder height can range between 1.5 and 4 mm. The length of a typical discharge tube would be between 30 and 250 mm. The diameter of the niobium tube is between 1.5 and 4 mm and wire materials would be used having a diameter between 0.5 and 0.1 mm. The life of lamps on test incorporating this invention have been, in some cases, quadrupled over those of prior lamps.

For example, 70 watt lamps with a shoulder member 2 mm high and 0.5 mm thick in accordance with the invention have still been running after 17,650 hours. Life for these lamps without a shoulder member would be 4,000 hours.

What we claim is:

1. A high pressure discharge lamp including a discharge tube having an arc wall of light transmitting ceramic material; a discharge sustaining fill within the discharge tube, the fill comprising a mixture of alkali metal and mercury vapour, and a quantity of starting gas, said mixture being condensable to provide an electrically conductive amalgam; electrodes within the discharge tube for initiating and maintaining a discharge; electrically conductive lead-in members joined within the discharge tube to respective electrodes for rendering the electrodes connectable to an electric supply; at least one end closure member sealed to an end of the discharge tube; and barrier means within the discharge tube preventing liquid amalgam, which is a condensate of said condensable mixture, from making electrical contact with the respective electrode and thereby the supply; the end closure member comprising an annular sealing element of said ceramic material extending radially inwardly of the arc tube wall and being sealed to the arc tube wall to define an end wall thereof having an aperture therein wherein a respective lead-in member is disposed in the aperture, to be connected within the arc tube to the respective discharge maintaining electrode, and has the barrier means disposed therearound in the form of a shoulder member between 1.5 and 1.4 mm in height and spaced from the arc tube wall, extending axially inwardly of the end wall to define an extension to the aperture and having a top surface facing inwards of the end of the arc tube, the respective lead in member being sealed along the aperture and extension thereof, the shoulder member being disposed and adapted to expose at least part of the respective end wall to radiation from the respective discharge maintaining electrode and the height and width of the shoulder member being arranged to provide a temperature differential due to lamp operation such that liquid amalgam will condense on the end wall in preference to the top surface.

2. A high pressure discharge lamp including a discharge tube having an arc wall of light transmitting ceramic material; a discharge sustaining fill within the discharge tube, the fill comprising a mixture of alkali metal and mercury vapour, and a quantity of starting gas, said mixture being condensable to provide an electrically conductive amalgam; electrodes within the discharge tube for initiating and maintaining a discharge; electrically conductive lead-in members joined within the arc tube to respective electrodes for rendering the electrodes connectable to an electric supply; end closure members sealed to the ends of the discharge tube; and barrier means within the discharge tube preventing liquid amalgam which is a condensate of said condensable mixture from making electrical contact with the electrodes and thereby the supply; each said end closure member comprising an annular sealing element of said ceramic material extending radially inwardly of the arc tube wall and being sintered to the arc tube wall to define an end wall thereof, having an aperture therein wherein a respective lead-in member is disposed in the aperture of each end closure member to be connected within the arc tube to a respective discharge maintaining electrode, and has disposed therearound said barrier means in the form of a shoulder member formed as an integral part of said end wall, said shoulder member being spaced from the arc tube wall and extending axially inwardly of the respective end wall to define an extension to the respective aperture and having a top surface facing inwards of the respective end of the arc tube, each lead-in member being sealed along the respective aperture and extension thereof, the shoulder member being between 1.5 and 4 mm in height and disposed and adapted to expose at least part of the end wall to radiation from the respective discharge maintaining electrode, the height and width of the shoulder member also being arranged to provide a temperature differential due to lamp operation such that liquid amalgam will condense on the end wall in preference to the top surface.

3. A high pressure discharge lamp including a discharge tube having an arc wall of light transmitting ceramic material; a discharge sustaining fill within the discharge tube, the fill comprising a mixture of alkali metal and mercury vapour, and a quantity of starting gas, said mixture being condensable to provide an electrically conductive amalgam; electrodes within the discharge tube for initiating and maintaining a discharge; electrically conductive lead-in members joined within the arc tube to respective electrodes for rendering the electrodes connectable to an electric supply; end closure members sealed to the ends of the discharge tube and barrier means within the discharge tube preventing liquid amalgam which is a condensate of the condensable mixture from making electrical contact with the electrodes and thereby the supply; each said end closure member being sealed to a respective end of the discharge tube and comprising an inwardly radially extending annular portion and a longitudinally extending barrel portion, each portion defining a central aperture, each said respective lead-in member being disposed in said central aperture to be connected within the arc tube to a respective discharge maintaining electrode, said respective discharge maintaining electrode having disposed therearound said barrier means in the form of a shoulder member between 1.5 and 4 mm in height forming an integral part of said longitudinally extending barrel portion and defining an extension of the central aperture, said shoulder member being spaced from the arc tube wall and having a top surface facing inwards of the respective ends of the discharge tube, the lead-in member being sealed along said central aperture including the extension thereof, the shoulder member in height disposed and adapted to expose at least part of the respective end of the discharge tube to radiation from the respective discharge maintaining electrode, the height and width of the shoulder member being arranged to provide a temperature differential, due to lamp operation, between the respective end of the discharge tube and said top surface such that liquid amalgam will condense on the respective end of the discharge tube in preference to said top surface.

4. A high pressure discharge lamp including a discharge tube having an arc wall of light transmitting ceramic material; a discharge sustaining fill within the discharge tube, the fill comprising a mixture of alkali metal and mercury vapour, and a quantity of starting gas, said mixture being condensable to provide an electrically conductive amalgam; electrodes within the discharge tube for initiating and maintaining a discharge; electrically conductive members within the arc tube for rendering the electrodes connectable to an electric supply; at least one end closure assembly sealed to an end of the discharge tube; and barrier means within the discharge tube preventing liquid amalgam which is a condensate of said condensable mixture from making electrical contact with the respective electrode and thereby the supply; the end closure assembly comprising an annular element of said ceramic material and an electrically conducting cermet member sealed to each other and to the arc tube, the cermet member being electrically connected to the respective conductive member; said annular element extending radially inwardly to define an end wall having a central aperture; said barrier means comprising a shoulder member formed as an integral part of said annular element and extending longitudinally inwardly of the end wall, said shoulder member being spaced from the arc tube wall, having a top surface facing inwards of the respective end of the arc tube and being between 1.5 and 4 mm in height so that said shoulder member is disposed around the respective conductive member to expose at least part of the wall of the arc tube to radiation from the respective discharge maintaining electrode and the height and width of the shoulder member being arranged to provide a temperature differential due to lamp operation between the end wall of the arc tube and the top surface such that liquid amalgam will condense on the end wall in preference to the top surface.

5. A high pressure discharge lamp according to claim 1 wherein the shoulder member is formed by an integral part of a shaped member sealed within an aperture in the end wall, said shaped member comprising a cover part substantially the same size as the end of the arc tube and a barrel portion extending through said aperture.

6. A high pressure discharge lamp according to claim 1 wherein the width of the shoulder member is between 0.2 and 0.5 mm.

7. A high pressure discharge lamp according to claim 1 wherein the height of the shoulder member is 2 mm and the width is 0.5 mm.

8. A high pressure discharge lamp according to claim 1 wherein the electrical lead in member comprises a niobium tube.

9. A high pressure discharge lamp according to claim 1 wherein the electrical lead in member comprises niobium wire.

10. A high pressure discharge lamp according to claim 1 wherein the electrical lead in member comprises an electrically conducting cermet.

11. A high pressure discharge lamp according to claim 1 wherein the arc tube comprises polycrystalline alumina.

* * * * *